United States Patent [19]

Pedgonay

[11] 4,353,181

[45] Oct. 12, 1982

[54] ELASTIC REBOUND COMPENSATOR FOR RIFLED GUNBARRELS

[76] Inventor: John S. Pedgonay, P.O. Box 127, Aberdeen, Md. 21001

[21] Appl. No.: 900,484

[22] Filed: Apr. 27, 1978

[51] Int. Cl.[3] ..... F41F 17/10

[52] U.S. Cl. ..... 42/78

[58] Field of Search ..... 42/78, 76 R; 89/14 R

[56] References Cited

U.S. PATENT DOCUMENTS

| | | | |
|---|---|---|---|
| 36,592 | 9/1862 | Atwater | 42/78 |
| 245,015 | 8/1881 | Reilly | 42/78 |
| 804,483 | 11/1905 | Lincoln | 42/78 |
| 868,938 | 10/1907 | Puff | 42/78 |
| 2,089,219 | 8/1937 | Moore | 42/78 |
| 3,525,172 | 8/1970 | Marshall et al. | 42/78 |

*Primary Examiner*—Charles T. Jordan

[57] ABSTRACT

A rifled gunbarrel has stepped relief narrowing width of lands on the sides which normally transmit torque to projectiles, the narrowing extending about one projectile length to the muzzle for isolating the influence of torsional relaxation of gunbarrel, which is normally a trajectory-perturbing factor on projectile emergence, while continuing radial contact for projectile guidance along the gunbarrel axis as the gunbarrel unwinds.

2 Claims, 3 Drawing Figures

ELASTIC REBOUND COMPENSATOR FOR RIFLED GUNBARRELS

This invention relates generally to firearms and particularly to rifling configurations.

Reaction from imparting spin to a projectile causes longitudinal elastic twist in a rifled barrel which tends to relax during projectile emergence, applying destabilizing counter force to the rear of the projectile which can perturbe projectile trajectory.

A principal object of the invention is to minimize this problem and provide improved accuracy in rifled gunbarrels generally, from ordnance to handguns, while preserving nearly all normal spin and distance imparted to projectiles.

In the prior art various disclosures concerning rifling configurations appear including those in the following U.S. Pat. Nos.

245,015 to H. Reilly, 9-2-81, discloses reduced-width lands adjacent the muzzle, but on the side opposite the torque-transmitting side of the lands;

804,483 to L. Lincoln, 11-14-05, discloses an outwardly tapering bore culminating in a cylindrical chamber of full diameter at the muzzle;

868,938 to C. Puff, 10-22-07, discloses the combination of rifling disappearing at the muzzle and radial vents near the muzzle;

2,089,219 to W. T. Moore, 8-10-37, discloses lands gradually narrowing from breech to muzzle;

3,525,172 to R. L. Marshall et al, 8-25-70, discloses rifling disappearing at a point in the length of the barrel.

In spite of the fact that termination in part or in whole of rifling, short of the muzzle end, is known, it is believed that the present invention will provide a long sought but never before found and synergistic advance in the art of rifled barrels.

In brief summary given for cursive description only and not as limitation, the invention includes provision of stepped longitudinal relief in the sides of rifling lands which impart projectile spin, for about one-projectile length adjacent the muzzle, preserving radial contact for guidance while permitting barrel torsional relaxation prior to projectile emergence.

The above and other objects and advantages of the invention will become more readily apparent on examination of the following description, including the drawings, in which like reference numerals refer to like parts:

Figure 1:
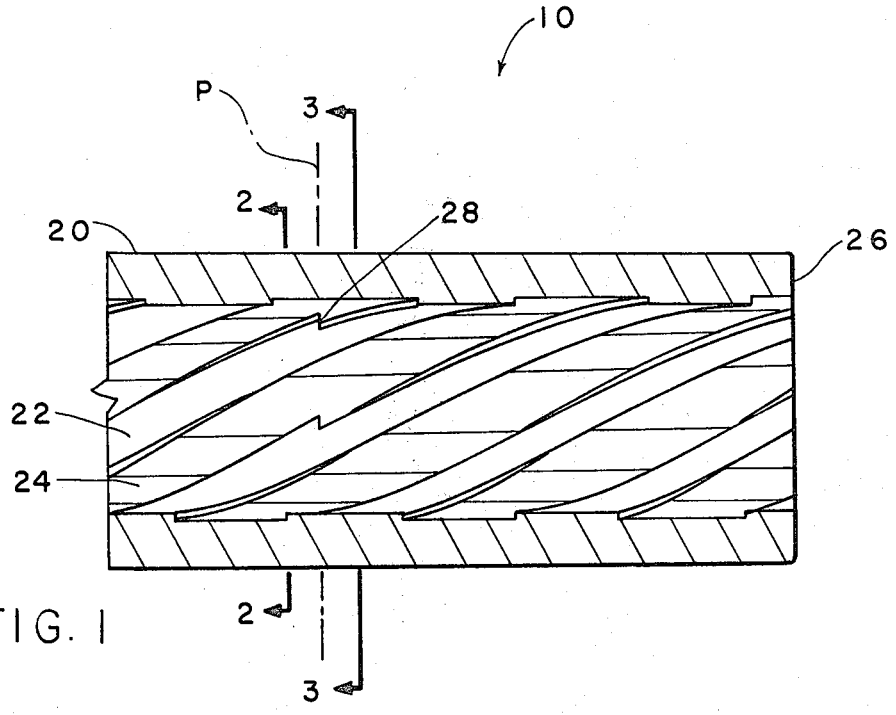
FIG. 1 is a longitudinal sectional diagram of a muzzle-adjacent portion of a rifled gunbarrel embodying the invention.

FIG. 1 shows the invention 10 embodied in a barrel 20 of ordnance having rifling of conventionally spiral lead with uniform lands 22 and grooves 24 extending from the breech to a position defined by transverse plane P adjacent the muzzle end 26. At this position all lands have abrupt relief 28 or step-down in width, as opposed to tapered reduction along the length. The relief continues to the muzzle, preferably uniformly.

Figure 2:
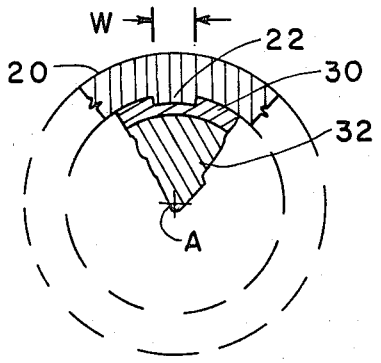
FIG. 2 is a fragmentary view adapted from 2—2, FIG. 1.
Figure 3:
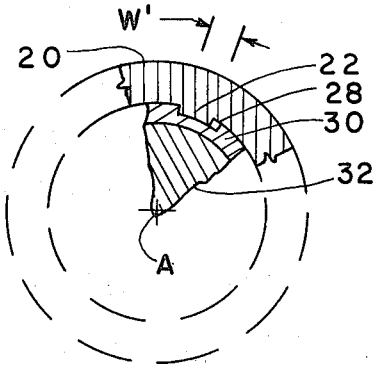
FIG. 3 is a fragmentary view adapted from 3—3, FIG. 2.

FIGS. 2 and 3 respectively illustrate in cross-sectional diagram using an artillery round as example, the relation of land 22 and sabot 30 of a projectile 32 just prior to and after the sabot passes the position in which the lands narrow, 28 being the relief, W and $W_1$ being land widths before and after the narrowing step, and A being the axis of the barrel 20.

Position of the plane where the narrowing step occurs, and amount of narrowing in land-width are to differ for each different application, always following principles of this invention.

As to the length of the relief, according to these principles, conventional relation of rifling and projectile are preserved to impart thrust and spin to the projectile up to the threshold of projectile emergence. This position may be defined in terms of a distance from the muzzle substantially equal to the length of the projectile ahead of the trailing seal of the projectile with the rifling. For example, in the case of a conventional artillery shell the trailing seal is defined for purposes of this invention as the expanded-sabot-contact with the rifling farthest from the muzzle. For purposes of the invention the length concerned may be called the projectile length.

As to width, the recess is made wide enough to prevent the spinning projectile from again touching the lands on the spin-imparting side, once separated from contact with them on that side at the step-down in width. The relief needed for any particular combination of rifling and projectile proportions will be quickly and positively ascertainable by anyone skilled in the art, as through consideration of the amount of circumferential motion of sabot periphery per unit of axial travel, and the length of the relief required.

As to abruptness of step, the function of the narrowing is to make a clean, nearly instantaneous break of contact between sabot structure carrying the load of torsional acceleration, and portion of land forcing the torsional acceleration, equivalent to the break of contact as the projectile leaves the muzzle end of an ordinary barrel, but with the final fillip on the tail end of the projectile neutralized by continuing guidance after passage of the step.

As to uniformity of narrowing of the land, the purpose is not merely to provide ease of manufacture, but to preserve the continuity and quality of radial contact with the projectile and in such way that it is not likely to be non-uniformly reduced in width by erosion at any point. There is little transition in radial contact, or friction, to perturb trajectory.

Once broken under the conditions specified, seal between projectile and rifling will not again occur. Gaseous blowby, because of the large rotational momentum of the projectile, because the blowby must follow the spiral lands and rotate with the contact between barrel and projectile, and because of the continuation of frictional characteristics in radial contact between barrel and projectile, can be expected to have inconsequential effect, except that it may, being somewhat precollimated, tend to equalize radial pressures during projectile emergence.

In conclusion, it will be appreciated that although the dynamic interaction is very complex among barrel, propellant forces and projectile, and may not be fully understood in the simplest case, much less in the large number of common variations, the present invention objectively isolates and treats a significant rifling problem in a geometrically understandable manner. It will be clearly evident that any attempt to alter rate of spiral advance of rifling to accomplish the same beneficial result would be impractical because such would be restricted narrowly to one set of firing parameters, which are notoriously difficult to maintain in the best of circumstances.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a barrel with spiral rifling for imparting spin to an elongate projectile with a trailing seal, the spiral rifling including longitudinal lands reduced in width at the muzzle end, the improvement comprising: said reduction in width being on the side of the lands imparting spin to the projectile and extending a distance along the barrel to the muzzle end substantially equal to the length of the projectile ahead of the trailing seal of the projectile, and said reduction in width being substantially a step-reduction substantially uniform in width.

2. The method of minimizing perturbation of path of a fired elongate projectile, caused by torsional relaxation of a spirally rifled barrel on elongate projectile emergence therefrom, while preserving the maximum of elongate projectile propulsion, comprising the steps;

(a) through a first portion of the barrel ending at the terminal muzzle portion guiding the elongate projectile axially by radial contact with the rifling while rotationally accelerating the elongate projectile by circumferential contact with the rifling; and (b) through the terminal muzzle portion of the barrel substantially equalling the elongate projectile length continuing to guide the elongate projectile by radial contact with said rifling while relieving the rotationally accelerative circumferential contact with the rifling, thereby minimizing perturbation of said path by said torsional relaxation.

* * * * *